United States Patent [19]

Ochi et al.

[11] 4,137,483

[45] Jan. 30, 1979

[54] HIGH PRESSURE DISCHARGE LAMP WITH A STARTING CIRCUIT CONTAINED THEREIN

[75] Inventors: Masafumi Ochi, Kitamoto; Motonobu Masui, Kumagaya; Ikuo Iwai, Ohmiya, all of Japan

[73] Assignee: Iwasaki Electric Co., Ltd., Tokyo, Japan

[21] Appl. No.: 747,019

[22] Filed: Dec. 2, 1976

[30] Foreign Application Priority Data

Dec. 2, 1975 [JP] Japan ..... 50-142398

[51] Int. Cl.[2] ..... H01J 7/24

[52] U.S. Cl. ..... 315/74; 315/47

[58] Field of Search ..... 315/74, 75, 83, 46, 315/47, 56, 100, 103, 104, 106, 107; 313/25, 184, 229, 312; 328/7; 337/33, 34

[56] References Cited

U.S. PATENT DOCUMENTS 3,226,597 12/1965 Green ..... 315/74

3,746,914 7/1973 Olson et al. ..... 315/47

*Primary Examiner*—Alfred E. Smith

*Assistant Examiner*—David K. Moore

*Attorney, Agent, or Firm*—Shapiro and Shapiro

[57] ABSTRACT

A high pressure discharge lamp with a starting circuit contained therein includes an arc tube provided with a pair of opposed electrodes at the hermetically sealed opposite ends thereof. The interior of the arc tube is filled with at least a luminous metal and gas. The discharge lamp further includes a series circuit consisting of a thermo-responsive switch and a resistor and shunted to the electrodes of the arc tube, and an outer envelope for containing therein the series circuit and the arc tube. The resistance value of the resistor is set such that a sufficient current to induce a pulse of higher voltage than the starting voltage flows through the series circuit while, on the other hand, the current flowing through the series circuit is substantially equal to or less than the lamp current during the stable state of the lamp.

8 Claims, 10 Drawing Figures

HIGH PRESSURE DISCHARGE LAMP WITH A STARTING CIRCUIT CONTAINED THEREIN

BACKGROUND OF THE INVENTION

1. Field of the Invention

This invention relates to a high pressure discharge lamp with a starting circuit contained within an outer envelope.

2. Description of the Prior Art

In a high pressure discharge lamp, especially a discharge lamp like a high pressure sodium vapor lamp having a fill of metallic sodium enveloped within an arc tube, the starting voltage is high, and usually ranges from 2 to 3 KV. The discharge lamp requiring such a high starting voltage cannot be turned on even if it is directly connected to a commercially available power source. In the past, therefore, a starter or a pulser has been added as an extraneous starting device of the discharge lamp to generate a pulse of higher voltage than the starting voltage of the discharge lamp so that such a pulse of high voltage may be applied to the discharge lamp during the starting. However, provision of such a separate starting device for generating a pulse of high voltage requires increased facilities and accordingly higher cost.

To overcome such problems, there has been proposed a discharge lamp which eliminates the extraneous starting device and has a starting circuit contained within the outer envelope or bulb of the discharge lamp. In the discharge lamp of this type, the starting circuit has comprised a combination of a nichrome wire and a bimetal switch and the operation of the bimetal switch has been controlled by heating of the nichrome wire so that a pulse of high voltage may be generated by selfinduction of a current in a stabilizer choke coil, and such pulse has been used as the trigger for the discharge lamp. However, in the starting of the discharge lamp, the current flowing through the nichrome wire is so great that the arc produced between contacts when the bimetal switch is opened is great enough to fuse the contacts together in some cases. This may result in an excess current flowing through the stabilizer to heat and burn the stabilizer or the connecting wires. A greater problem is that since the current flowing through the nichrome wire is great as already noted, the pulse voltage induced in the stabilizer choke coil is extremely high and usually exceeds 10 KV. When a discharge lamp requiring a high starting voltage is to be started, a pulse of higher voltage than the starting voltage must be applied to the discharge lamp, but if the pulse voltage is higher than required voltage, there is the possibility of damaging the stabilizer or the connecting wires. It is therefore necessary to control the starting current flowing at the starting of the discharging lamp, as well as the pulse voltage generated by the starting current.

On the other hand, in the discharge lamp of the described type having a simple starting circuit consisting of a nichrome wire and a bimetal switch and contained within the outer envelope of the discharge lamp, a problem occurs as to how to accommodate the starting circuit in the internal space of the envelope so as not to intercept the light emitted from the light emitting tube. Further, whether the discharge lamp can be safely and reliably started or not becomes an important point.

SUMMARY OF THE INVENTION

It is therefore an object of the present invention to provide a high pressure discharge lamp with a starting circuit contained within the outer envelope of the discharge lamp, whereby the current flowing through the circuit at the starting of the discharge lamp may be suppressed to a predetermined value to control the pulse voltage induced in the stabilizer choke coil.

It is another object of the present invention to provide such a high pressure discharge lamp whose efficiency of irradiation is not affected and which may be easily started.

It is still another object of the present invention to provide such a high pressure discharge lamp in which the thermoresponsive switch of the starting circuit is endowed with a snap action function to ensure reliable starting of the discharge lamp.

It is yet still another object of the present invention to provide such a high pressure discharge lamp in which the thermoresponsive switch of the starting circuit is endowed with a snap action function and the switch presents a hysteresis characteristic with respect to temperature.

It is a further object of the present invention to provide such a high pressure discharge lamp in which the resistor of the starting circuit is disposed in proximity to the light emitting tube so that the lamp may be easily started, especially, restarted.

The invention will become more fully apparent from the following detailed description thereof taken in conjunction with the accompanying drawings.

DESCRIPTION OF THE PREFERRED EMBODIMENTS

Figure 1:
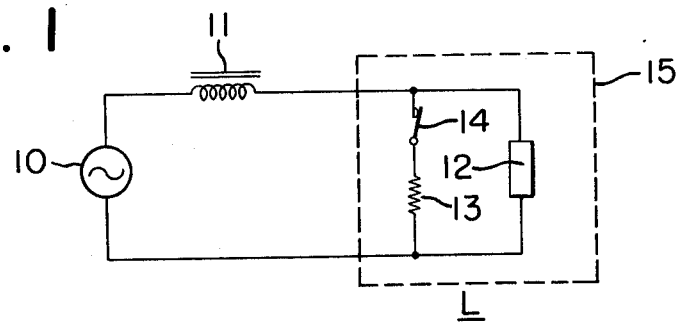
FIG. 1 is a basic circuit diagram illustrating the principle of the starting of the high pressure discharge lamp according to the present invention.

Referring to FIG. 1 which diagrammatically shows the basic circuit of the present invention, a light emitting tube 12 is series-connected to an AC power source 10 through a stabilizer choke coil 11, thereby constituting the main circuit for a discharge lamp L. Although not shown, the light emitting tube 12 has a pair of discharge electrodes provided at the hermetically sealed opposite ends thereof. The tube is filled with an inert gas such as mercury, argon or xenon, to which a necessary element may be added as desired. For example, in the case of a high pressure sodium vapor lamp, the necessary element added may be a suitable quantity of sodium.

According to the present invention, a circuit comprising a serial connection of a resistor 13 like tungsten filament and a thermo-responsive switch, e.g. a bimetal switch 14, is shunted across the light emitting tube 12 provided with the electrodes at the opposite ends thereof. The series circuit comprising the resistor 13 and the bimetal switch 14, with the light emitting tube 12, is contained within an outer envelope 15, thereby constituting the discharge lamp L. The bimetal switch 14 contained within the outer envelope remains closed before the lamp is started, as shown.

When, in this state, the AC power source 10 is switched on to turn on the discharge lamp, a current flows through the closed bimetal switch 14 and the resistor 13. In this case, the starting voltage of the discharge lamp L is quite high, say, 2 to 3 KV for a sodium vapor lamp, and therefore, even if a commercially available AC power source is connected to the lamp, no discharge will occur between the opposite electrodes of the light emitting tube 12 and the discharge lamp L will not turn on.

After the AC power source 10 is switched on, the bimetal switch 14 is heated by the heat energy emitted from the resistor 13 and reaches a predetermined temperature, whereupon the bimetal switch 14 opens its contact to cut off the current. As a result, a high voltage pulse is induced in the stabilizer choke coil 11. Since the bimetal switch is opened, the high voltage pulse induced in the stabilizer choke coil 11 is applied to the opposite electrodes of the light emitting tube 12, so that dielectric breakdown is caused within the light emitting tube. Thus, discharge is started between the opposite electrodes of the light emitting tube 12 to thereby turn on the discharge lamp L.

Since, as already mentioned, the starting voltage of a discharge lamp like a high pressure sodium vapor lamp is high, and usually of the order of 2 to 3 KV, the high voltage pulse induced in the stabilizer choke coil at the time of starting must be higher than at least the starting voltage. To ensure a discharge lamp to be started reliably, a pulse of considerably higher voltage than the starting voltage of the discharge lamp should desirably be induced in the stabilizer choke coil, but a pulse of higher voltage than necessary, if induced, would cause breakdown of the stabilizer or the wires which might in turn result in a danger such as damages to these or occurrence of fire. For this reason, the magnitude of the pulse induced in the stabilizer choke coil, namely, the amplitude and pulse energy of the pulse, should be selected to suitable values. Since the inductance of the stabilizer choke coil is determined in dependence on the discharge lamp to be turned on, the magnitude induced in the stabilizer choke coil at the starting is determined as a function of the current flowing through the resistor 13. Therefore, the current flowing through the resistor 13 must be controlled to provide an induced pulse of desired voltage.

On the other hand, too great a current flowing through the resistor 13 would cause the contacts of the bimetal switch 14 to open with such a great inter-contact arc as would cause burning and fusion of the contacts and might accordingly impart damages to the stabilizer. Therefore, from this point of view, also, the current flowing through the series circuit of the resistor 13 and the bimetal switch 14 must be controlled.

Figure 2:
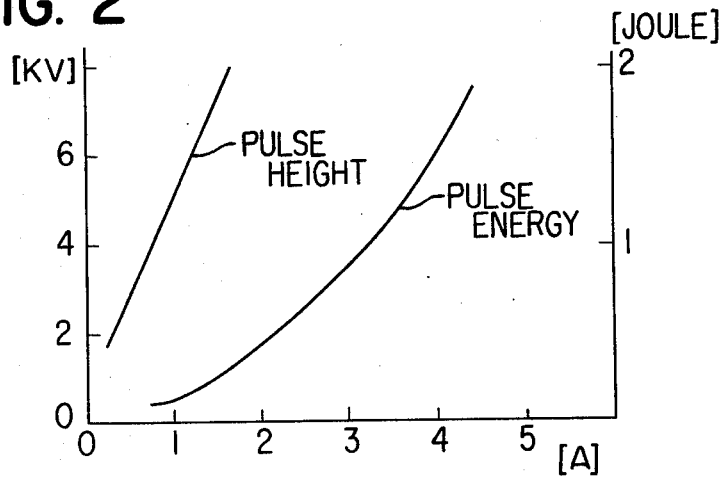
FIG. 2 is a graph illustrating the voltage and pulse energy of the high voltage pulse induced for the current flowing through the resistor.

FIG. 2 is a graph illustrating the relation between the current flowing through the switch 14 and the pulse induced in the choke coil 11 when the choke coil used is a stabilizer choke coil of 400 W having inductance of about 0.1 H. In the graph of FIG. 2, the abscissa represents the pulse voltage. Further, in FIG. 2, the relation between the power source and the pulse energy is plotted. As seen from FIG. 2, when a current of 1 A flows through the resistor 13, a pulse of high voltage 5 KV is induced in the stabilizer choke coil 11. Therefore, where a discharge lamp, for example, a high pressure sodium vapor lamp which requires a starting voltage ranging from 2 to 3 KV, is used, a current of the order of 1 A flowing through the resistor 13 will be sufficient to start the discharge lamp L reliably. In such case, the pulse energy is as small as a fraction of 1 joule and it may thus be said that there is no danger of the stabilizer choke coil 11 being damaged by the induced pulse of high voltage.

Likewise, a current of 1.2 A flowing through the resistor 13 will induce a pulse of high voltage of about 6 KV in the stabilizer choke coil 11, thus enabling a discharge lamp like a high pressure sodium vapor lamp to be started more reliably. Again in this case, the pulse energy of the high voltage pulse induced in the stabilizer choke coil 11 is so small that the problem of damages imparted to the choke coil will not occur.

Figure 3:
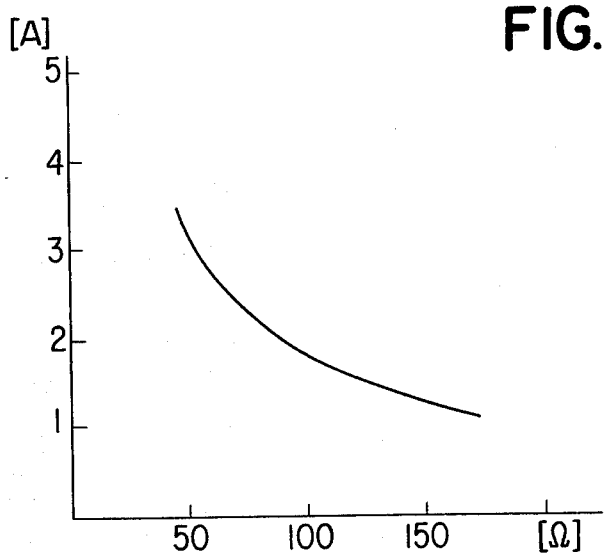
FIG. 3 is a graph illustrating the relation between the resistance of the resistor and the current flowing therethrough.

FIG. 3 is a graph for illustrating the relation between the resistance value of the resistor and the current flowing therethrough when use is made of a stabilizer choke coil of 400 W having an inductance of about 0.1 H. The abscissa represents the resistance value of the resistor and the ordinate represents the current flowing through the resistor. As is apparent from FIG. 3, the resistance value of the resistor should be of the order of 170 Ω in order that a current of 1 A may flow through the resistor. In other words, if the resistance value of the resistor is selected to the order of 170 Ω, there is provided a pulse of starting voltage of the order of 5 KV. Likewise, if a current of 1.2 A is caused to flow through the resistor to provide a pulse voltage of 6 KV in the foregoing example, the resistance value of the resistor should be set to 165 Ω and this resistance value will ensure the starting of the discharge lamp.

Usually, the current capacity of the stabilizer choke coil is designed by using, as reference, the lamp current in the discharge lamp when in turned-on and stable state. Therefore, in order to prevent any accident such as burning or the like of the stabilizer choke coil, the current flowing through the choke coil should be, at highest, of the order of the lamp current in the lamp when in its stable state. With a high pressure sodium vapor lamp of 400 W taken as an example, the lamp current in the stable state of the lamp is of the order of 4.7 A and it is thus desirable that the current flowing through the resistor at the starting be, at highest, of the order of 5 A. Should a current greater than the lamp current in the stable state of the lamp flow through the resistor 13, a great current will flow to the switch 14 to cause the contacts thereof to be fused together by the inter-contact arc when aging or the like of the discharge lamp prevents it from being turned on in spite of the power source being switched on, and this may result in a burnt stabilizer.

As will be seen from what has been previously described, the resistance value of the resistor 13 required for a current of 1.2 A to flow therethrough is about 165 Ω and thus, if the resistance value of the resistor is selected to this value, a current less than the lamp current in the stable state of the lamp will flow through the series circuit comprising the resistor and the bimetal switch. Therefore, in order to start the discharge lamp L reliably, the lower limit of the resistance value of the resistor must be set such that a sufficient current to generate an induced pulse of sufficiently higher voltage than the starting voltage of the discharge lamp may flow through the resistor 13 while, on the other hand, the upper limit of the resistance value of the resistor should be set such that a current of the order equal to or less than the lamp current in the stable state of the discharge lamp may flow through the resistor.

Where commercially available tungsten filament is used as the resistor 13, a considerable length of such filament is required to provide the necessary resistance value and this will involve the necessity for sufficient consideration to be given to the arrangement of the resistor 13 when it is to be contained within the outer envelope.

Incidentally, if a conductor is provided adjacent to the light emitting tube of the discharge lamp and a potential is imparted to the conductor, a potential gradient will be created between the conductor and the electrodes of the light emitting tube and as the potential gradient is greater, the two electrodes of the light emitting tube will become apparently closer to each other, the result of which is that ionization of the substances enveloped in the light emitting tube is expedited to thereby make the discharge lamp easier to turn on, as is well-known. The conductor intentionally disposed adjacent to the light emitting tube and having a potential imparted thereto for the abovedescribed purpose is commonly called the "proximate conductor", and the present invention positively adopts such technique and intends to cause the resistor used in the starting circuit to perform the function of the proximate conductor as well.

The high pressure discharge lamp containing therein the starting circuit according to the present invention in which the resistor of the starting circuit serves also as the proximate conductor will hereinafter be described with respect to some embodiments thereof.

Figure 4:
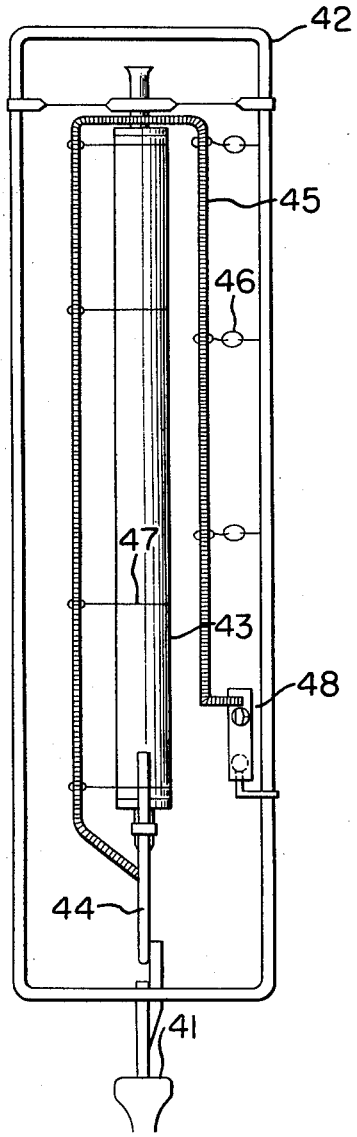
FIGS. 4, 5, 6, 7 and 8 are partly cut-away perspective views of the discharge lamps according to a first, a second, a third, a fourth and a fifth embodiment, respectively, of the present invention and showing them with the outer envelope removed.

Referring to FIG. 4, essential portions of the discharge lamp according to a first embodiment of the present invention are shown with the outer envelope removed. In this embodiment, the resistance value of the resistor shunted to the discharging path of the light emitting tube is set within the aforementioned upper and lower limits by the present invention. In the embodiment of FIG. 4, a frame-shaped metallic mount strut 42 is mounted on a stem 41 extending from the base portion of the outer envelope (not shown) and having a lead wire extending therethrough. A light emitting tube 43 has its top portion secured to the mount strut 42 by suitable means and has its bottom portion secured to a support 44. Electrical connection to the upper electrode (not shown) of the light emitting tube 43 is made through the mount strut, and electrical connection to the lower electrode of the light emitting tube 43 is made through the support 44.

According to the first embodiment of the present invention, a resistor 45 like tungsten filament is extended circumferentially of the light emitting tube 43 along the axis thereof, one arm portion of the resistor 45 being supported on the mount strut 42 by means of a plurality of insulating filament supports 46 and the other arm portion of the resistor 45 being supported on the light emitting tube 43 by means of a plurality of filament supports 47. A bimetal switch 48 is connected to one end of the resistor 45 and this bimetal switch is mounted on the mount strut 42 in a suitable manner and given electrical connection through the mount strut. The other end of the resistor 45 is mechanically and electrically connected to the support 44. Thus, the serial connection of the resistor 45 and bimetal switch 48 is shunted across the discharging path of the light-emitting tube.

Figure 5:
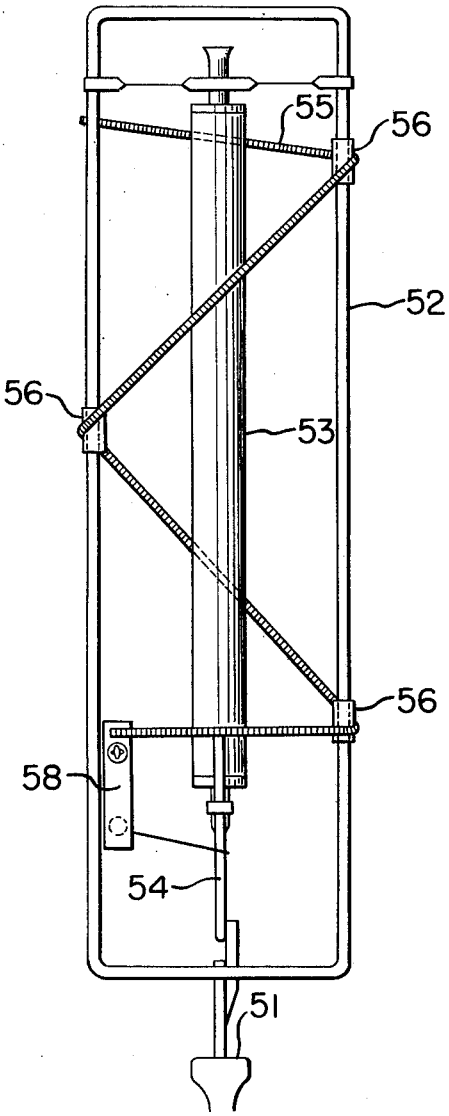

Referring to FIG. 5 which shows a second embodiment of the present invention, essential portions of the discharge lamp are only shown with the outer envelope removed. A frame-shaped metallic mount strut 52 is mounted on a stem 51 rising from the base portion of the outer envelope (not shown) and having a lead wire extending therethrough. A light emitting tube 53 has its top portion secured to the mount strut 52 by suitable means and has its bottom portion secured to a support 54. Electrical connection to the upper electrode (not shown) of the light emitting tube 53 is made from the lead wire through the mount strut, and electrical connection to the lower electrode (not shown) of the light emitting tube 53 is made through the support 54.

In the embodiment shown in FIG. 5, the resistor 55 is extended around the mount strut 52 with insulating pads 56 interposed therebetween, and one end of the resistor 55 is welded to a point on the mount strut 52 which is adjacent to the upper electrode of the light emitting tube 53, and it is disposed so that a portion of the resistor is interlinked with the upper electrode. The other end of the resistor 55 is connected to one terminal of the bimetal switch 58 secured to the mount strut 52 adjacent to the lower electrode, and it is disposed so that a portion of the resistor 55 is interlinked with the lower electrode. The intermediate portion of the resistor 55 extends at a suitable inclination with respect to the light emitting tube in accordance with the length of the intermediate portion so as to prevent any slack thereof. The other terminal of the bimetal switch 58 is electrically and mechanically connected to the metallic support 54. Thus, electrically, the starting circuit comprising the resistor 55 and the bimetal switch 58 is parallelconnected to the light emitting tube 53, and the resistor of the starting circuit is disposed so as to perform the function of the proximate conductor.

Figure 6:
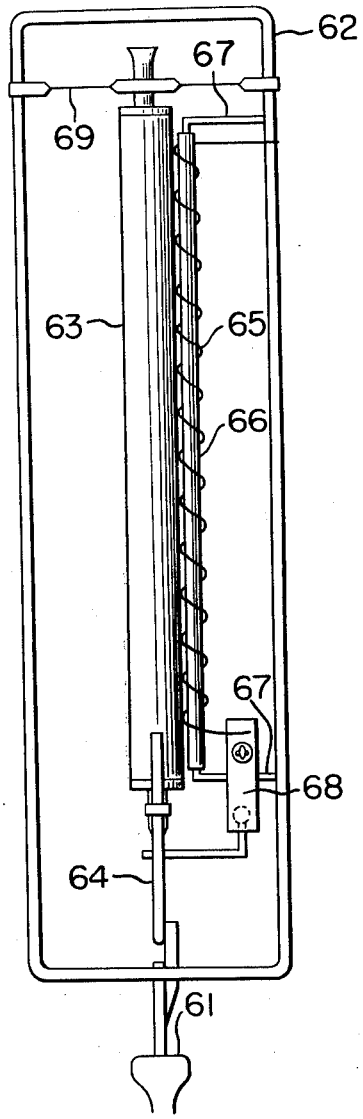

Referring to FIG. 6 which shows a third embodiment of the present invention, essential portions of the discharge lamp are only shown with the outer envelope removed, as in FIG. 5. As in the embodiment of FIG. 5, a metallic mount strut 62 is suitably mounted on a mount 61 having a lead wire extending therethrough. The top of a light emitting tube 63 is mechanically secured to the mount strut 62 by means of a tungsten lead 69 and the upper electrode of the light emitting tube 63 is electrically connected to the mount strut. The bottom of the light emitting tube 63 is secured to a metallic support 64, to which is electrically connected the lower electrode of the light emitting tube.

In the embodiment shown in FIG. 6, an insulative ceramic pipe 66 is disposed adjacent to the light emitting tube 63 and substantially along the entire length thereof, and this insulating ceramic pipe 66 is secured to the mount strut 62 by means of supports 67. A resistor 65 is wound on the ceramic pipe 66 along the entire length thereof, and the upper end of the resistor is spot-welded to the mount strut 62 adjacent to the upper electrode of the light emitting tube. The lower end of the resistor 65 extends to the vicinity of the lower electrode of the light emitting tube 65 and is connected to one terminal of a bimetal switch 68 attached to the support 67. The other terminal of the bimetal switch 68 is electrically connected to the support 64. Thus, the serial starting circuit comprising the resistor 65 extending substantially along the entire length of the light emitting tube 63 adjacent thereto and the bimetal switch 68 is parallel-connected to the light emitting tube.

Figure 7:
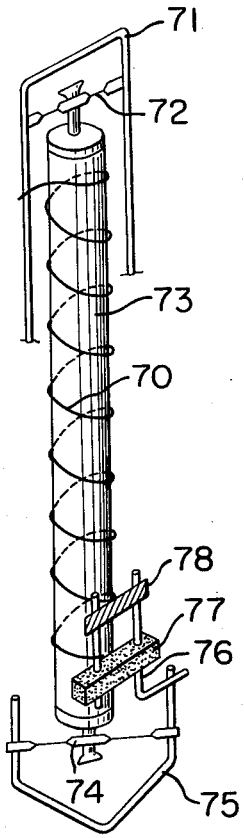
Figure 8:
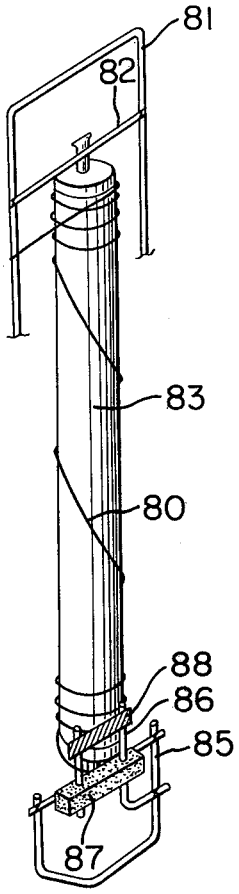

Referring to FIGS. 7 and 8 which respectively show a fourth and a fifth embodiment of the present invention, essential portions of the discharge lamp are fragmentarily shown with the outer envelope removed. In the embodiment of FIG. 7, a metallic strut 71 is mounted on a stem (not shown) and the upper end of a light emitting tube 73 is supported on the strut by means of a tantalum lead member 72 and moreover, the upper electrode (not shown) of the light emitting tube is electrically connected to the strut. The lower end of the light emitting tube 73 is mounted on a metallic auxiliary strut 75 by means of a tantalum lead member 74 and so mechanically supported thereby, and the lower electrode of the light emitting tube is electrically connected to the auxiliary strut. A bimetal switch support 77 is also mounted on the auxiliary strut by means of a conductive member 76, and a bimetal switch 78 is mounted on the bimetal switch support 77, with one contact of the bimetal switch 78 being connected to the auxiliary strut through the conductive member 76. As will be apparent, the strut 71 provides one conductor and the auxiliary strut 75 provides the other conductor, these struts being insulated from each other and connected to lead wires led in from the base portion of the outer envelope of the discharge lamp.

In the embodiment of FIG. 7, a resistor 70 is wound on the outer periphery the light emitting tube 73 along the entire length thereof and at a uniform pitch. One end of the resistor 70 is welded to the strut 71 adjacent to the upper electrode of the light emitting tube 73. The other end of the resistor 70 is connected to the terminal of the bimetal switch 78 adjacent to the lower electrode. As shown in FIG. 7, the resistor 70 is wound on the light emitting tube 73 substantially along the entire length thereof and at a uniform pitch which may be any desired pitch in accordance with the length of the resistor 70. A great advantage of this embodiment is that the very short distance between the resistor 70 and the electrodes enables the resistor to fully perform the function of the proximate conductor.

The helical resistor as shown in FIG. 7 may preferably be shaped in a manner which will be described below. First, a wire-like resistor is wound at a uniform pitch on a tubular or cylindrical member (not shown) whose diameter is somewhat less than the diameter of the light emitting tube on which the resistor is to be mounted. Subsequently, the wound resistor is removed from the tubular or cylindrical member and treated at a high temperature. If the resistor is tungsten, it will be subjected to recrystallizing treatment, and if the resistor is tantalum nitride, it will be subjected to nitriding treatment. The helical resistor so provided may be mounted on the light emitting tube 73 in the manner as shown in FIG. 7. Since the inside diameter of the resistor is smaller than the outside diameter of the light emitting tube, the resistor when mounted on the outer periphery of the light emitting tube is acted on by a tension so that the resistor is prevented from deviating or dangling with temperature rise.

In the embodiment of FIG. 8, a resistor 80 is wound on a light emitting tube 83 densely in the portions thereof adjacent to the opposite electrodes and sparsely in the intermediate portion of the tube. Such different pitches of the resistor 80 are useful to reduce the interception of the light emitted from the light emitting tube, thus improving the reduction rate of the light. Further, the densely wound resistor has a high efficiency as a heat source and therefore, if a bimetal switch 88 is installed adjacent thereto, there is an advantage that the bimetal switch can reach a predetermined temperature earlier. Again in the embodiment of FIG. 8, as in that of FIG. 7, one end of the resistor 80 is welded to a strut 81 adjacent to the lower electrode and the other end of the resistor is connected to one terminal of the bimetal switch 88 adjacent to the lower electrode.

In the embodiment of FIG. 8 wherein the resistor is wound on the light emitting tube, as in the embodiment of FIG. 7, a current flowing through the resistor may cause deviation or dangling of the resistor due to gravity or vibration to occur with temperature rise. This is undesirable not only in that the intended effect may not be achieved but also in that the illumination distribution on the surface illuminated is affected. To avoid this, the resistor used in the embodiment of FIG. 8 is pre-shaped in the following manner. To shape the helical resistor used in the embodiment of FIG. 8, a cylindrical or tubular member (not shown) having a diameter less than that of the light emitting tube is first prepared, and then the intermediate portion of a resistor having a predetermined length is sparsely wound on the tubular or cylindrical member while the portions of the resistor corresponding to the opposite electrodes of the light emitting tube are densely wound on the tube. The wound resistor is withdrawn from the tubular or cylindrical member and subjected to heat treatment. If the resistor is tungsten, it will be subjected to recrystallizing treatment, and if the resistor is tantalum nitride, it may be subjected to nitriding treatment. The resistor so treated is mounted on the outer periphery of the light emitting tube 83 in the manner as shown in FIG. 8, whereby there is provided a resistor for starting circuit which will experience no deviation deformation.

However, even the resistor shaped in the abovedescribed manner may experience extreme deformation depending on such factors as the attitude in which the discharge lamp is turned on or the condition of vibration of the discharge lamp, which may in turn prolong the starting time or cause abnormal temperature rise due to the contact between heating wires, thus resulting in a blackened outer envelope or a cracked light emitting tube.

Figure 9:
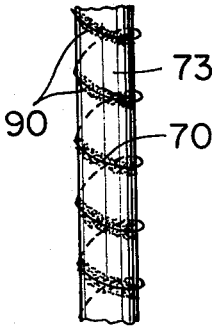
FIGS. 9 and 10 are fragmentary perspective views showing further modifications of the invention.

To avoid these, it is desirable that a heating wire be wound in a plurality of turns on the light emitting tube and secured to the outer surface of the tube by means of heat-resistant adhesive, as shown in FIG. 9, where the heating wire 70 of FIG. 7, for example, is shown secured to the tube 73 by heat-resistant adhesive 90. This eliminates the necessity of forming concavo-convexity in the outer surface of the light emitting tube to permit the heating wire to be secured thereto as has heretofore been done with the conventional light emitting tubes, and this in turn means great ease of the manufacture and uniform thickness of the light emitting tube which also assumes a great mechanical strength of the tube.

Figure 10:
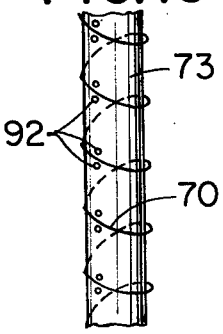

Alternatively, a plurality of protrusions 92 as shown in FIG. 10 may be formed by heat-resistant adhesive at suitable intervals on the outer surface of the light emitting tube and a heating wire wound between the protrusions, thereby obtaining the same effect as described. If the heat-resistant adhesive has a thermal expansion coefficient equivalent to that of the light emitting tube, there may be obtained a good result.

If the thermoresponsive switch used in the starting circuit of the present invention is endowed with a snap action function, the starting characteristic may be improved. Description will hereinafter be made of a case where a bimetal switch is used as the thermoresponsive switch. To endow the bimetal switch with a snap action function, the bimetal switch may readily be designed simply by varying the curved shape of the bimetal or by regulating the degree of drawing and at the same time, the bimetal switch may be endowed with hysteresis characteristic. If the bimetal switch endowed with the snap action function is further endowed with the hysteresis characteristic, the bimetal switch may be opened at a first temperature $T_1$ and maintain its open position at temperature above $T_1$. When the temperature begins to fall, the bimetal switch is not closed at the first temperature $T_1$ but is only closed at temperature below the first temperature $T_1$.

However, the current flowing through the resistor of the starting circuit at the starting is limited as already noted, and the heating value of the resistor is also limited accordingly. On the other hand, the thermoresponsive switch in the starting circuit is accommodated within the outer envelope of the discharge lamp and the interior of the outer envelope is in a highly vacuum state, so that there is acting no convection within the outer envelope and the response of the thermoresponsive switch results only from heat radiation.

Therefore, at least one surface, or preferably both surfaces, of the bimetal switch should desirably be provided with a black substance having a high heat absorption factor. Although several black substances may be mentioned as available, the substance such as zirconium, titanium, niobium or tantalum having the action of a getter is desirable in order to maintain the high degree of vacuum within the outer envelope. One or more substances chosen from among these has been mixed with a tackifier and the mixture has been applied to the surfaces of the bimetal, and then the bimetal has been baked. When the bimetal switch having the surfaces thereof coated with the black substance and accommodated within the outer envelope and a conventional bimetal switch having no coating of the black substance have been empirically compared as to their response characteristics, it has been found that the former starts in 18 (eighteen) seconds while the latter requires a starting time of 30 (thirty) seconds.

The use of the bimetal switch having a snap action eliminates the chattering of the switch contacts during the opening thereof and enables reliable and stable starting to be accomplished and in addition, the hysteresis characteristic of such bimetal switch does not permit the bimetal to restore its normal state once the contact thereof is opened and thus, the starting characteristic of the discharge lamp is greatly improved.

Further, according to the present invention, the current flowing through the tungsten filament is limited but the bimetal surfaces of the bimetal switch are coated with a black substance of high heat absorption factor, so that the starting time can be shortened and the starting can be accomplished easily.

What we claim is:

1. A high pressure discharge lamp connected to a power supply by an inductive reactance element, comprising a hermetically sealed light emitting tube provided with a pair of opposed electrodes, the interior of the light emitting tube being filled with at least a luminous metal and gas, a series starting circuit including a normally closed thermoresponsive switch and a resistor in series shunted across said electrodes, and an evacuated outer envelope containing therein said series starting circuit and said light emitting tube, the resistance value of said resistor being set such that: (1) a current flows through said series starting circuit sufficient to open said thermoresponsive switch in response to heating of said resistor before a discharge is started between said electrodes and sufficient to induce across said reactance element a pulse of voltage higher than the starting voltage of said lamp when said thermoresponsive switch opens, thereby to start a discharge between the electrodes, and (2) the current flowing through said series starting circuit is substantially equal to or less than the lamp current during the stable state of the lamp, whereby the pulse energy is insufficient to damage the reactance element, and the current through the switch is insufficient to damage the switch when it opens.

2. A high pressure discharge lamp according to claim 1, wherein said resistor is disposed substantially along the entire length of said light emitting tube with the opposite ends thereof located adjacent to said electrodes, respectively.

3. A high pressure discharge lamp according to claim 2, wherein said resistor is wound on the outer surface of the light emitting tube and throughout the entire length thereof, said resistor being wound less densely on the intermediate portion of said light emitting tube than on the opposite end portions of said tube.

4. A high pressure discharge lamp according to claim 2, wherein said resistor is pre-shaped in a helical form having a diameter less than the outside diameter of said light emitting tube and treated to form a helical resistor, said helical resistor being mounted on the outer periphery of said light emitting tube and throughout the entire length thereof.

5. A high pressure discharge lamp according to claim 2, wherein said resistor is secured to the outer surface of said light emitting tube by means of a heatresistant adhesive.

6. A high pressure discharge lamp according to claim 2, wherein a plurality of protrusions are formed by a heat-resistant adhesive on the outer surface of said light emitting tube and said resistor is wound between adjacent protrusions.

7. A high pressure discharge lamp according to claim 1, wherein said thermoresponsive switch is provided with a snap action mechanism having a hysteresis characteristic with respect to temperature so that the switch re-closes at a temperature lower than that at which it opens.

8. A high pressure discharge lamp according to claim 7, wherein said thermoresponsive switch comprises a bimetal switch, at least one surface of the bimetal being provided with a black substance of high heat absorption factor.

* * * * *